United States Patent [19]

Gorski et al.

[11] Patent Number: 4,932,667

[45] Date of Patent: Jun. 12, 1990

[54] METHOD OF PLAYING A PERFORMING ARTIST GAME

[75] Inventors: Cindy Gorski; Ray Gorski, both of Ventura, Calif.

[73] Assignee: Gorski and White Games Unlimited, a California General & Partnership, Westlake, Calif.

[21] Appl. No.: 287,852

[22] Filed: Dec. 21, 1988

Related U.S. Application Data

[63] Continuation of Ser. No. 895,498, Aug. 11, 1986.

[51] Int. Cl.[5] ..... A63F 3/00; A63F 9/18

[52] U.S. Cl. ..... 273/249; 273/1 G

[58] Field of Search ..... 273/249, 243, 1 G, 296, 273/292, 248

[56] References Cited

PUBLICATIONS

Wood, Clement, "The Complete Book of Games", Doubleday & Company, Inc., p. 456b, 1938, copy furnished in Group 330.

"Trivial Pursuit", Master Game-Rules of Play, Selchow & Righter Col, 1981 copy furnished in Group 330.

"The Charade Game", Games Magazine, November, 1985, pg. 32, copy furnished in Group 330.

"The Charade Game", Games Magazine, November, 1986, p. 29, copy furnished in Group 330.

*Primary Examiner*—Benjamin Layno

*Attorney, Agent, or Firm*—Daniel J. Meaney, Jr.

[57] ABSTRACT

A performing artist game, including a game board with a playing surface containing a first space in the form of a five pointed star and a group of second spaces defining a five pointed star in a playing path surrounding the first star, is shown. Points of the first star and second star define a transition path where play is commenced and terminated. The group of second spaces contains indicia indicative of five performing art fields and indicia representing a combination of opportunity and/or calamity to vary the game. Play pieces are used for movement during the game. A chance device is used to randomly determine the number of spaces a play piece is advanced. Audition cards are used which contain a situation side and a team question side. The situation side includes indicia defining a plurality of performing artist roles which correspond to the indicia indicative of performing art fields on the playing path. The team question side includes text defining a multipart answer to a team question relating to performing artist roles. In play, the performing player reads aloud the corresponding team question from the audition card. The performing player then performs the assigned role. The other members of the playing team must answer part or all of the multipart answer required to the team question based upon the performance rendered by the performing player.

9 Claims, 5 Drawing Sheets

METHOD OF PLAYING A PERFORMING ARTIST GAME

This is a continuation of application Ser. No. 06/895,498 filed Aug. 11, 1986, now abandoned.

BACKGROUND OF THE INVENTION

1. Field of the Invention

This invention relates to a game having a game board, playing pieces, a chance device, audition cards and opportunity/calamity cards which control the playing of a performing artist game; and, more particularly, to a performing artist game in which players are divided into playing teams which compete with each other. Each team member also is required to act as a performing player and performs a performing artist role based on information contained on the situation side of an audition card. The audition card also has a team question side containing questions requiring multipart answers. The other members of the playing team answer the team question based on the performing player's performance. The play pieces are moved along the star patterned playing path. Throughout the game, each member of each playing team is given the opportunity to perform as a performing artist. The object of the game is for one of the playing teams to reach the area designated as CENTRAL CASTING and for that playing team to answer at least two parts of the multipart answers required to the selected team question shown on the audition card.

2. Description of the Prior Art

Games which have teams competing with each other and which require members of each playing team to perform roles are well known in the art. One example of such a game is the game known as "Charades". In the game of "Charades", prior to commencement of play, well known quotes, sayings and the like are prepared in the form of playing slips and deposited in a common pile. Each playing team then, in turn, has one of its members designated as the performing player. When it is that performing team's turn, a designated performing player draws one of the playing slips from the common pile. The performing player, subject to the restriction that audible communication is not permitted to the other members of the playing team, must silently convey to the other members of the playing team the quotes, sayings or the like contained on the playing slip using hand signals and other appropriate body movements.

Another known popular game involving competing playing teams is the game of "Trivial Pursuit". The game of "Trivial Pursuit" includes: a game board, playing pieces and inquiry cards containing a plurality of multifield questions each requiring a specific, single answer, and the answers to the questions. The inquiry cards contain symbols that are keyed to symbols on the playing board surface. The playing team moves the play piece around a playing path having a number of independent spaces which extend through a circle, the center of the circle, and through a plurality of diameter lines. The playing path symbols contain indicia representing different specialized fields of knowledge which are keyed to each inquiry card. A playing team moves its game piece to a location on the playing path, the number of moves being determined by roll of a die. When the playing piece is advanced the number of moves designated by the die, the field of knowledge to be tested is represented by the symbol on the last space of the move. The playing member of the playing team then draws an inquiry card, and shows the drawn inquiry card to the opposing team members, but not the playing team members, so that the opposing team can be advised of the correct answer to the question. The playing member then reads the question aloud to the other members of the playing team. The playing team members have a designated period of time to provide the correct answer to the question. Upon giving the correct answer, the performing team is awarded a scoring marker, a number of which are accumulated throughout the game. The object of play is for each playing team to collect the requisite number of scoring markers and to reach the center of the circular path with the score pieces before any other playing team.

Other games which utilize a playing board, game pieces and cards wherein individual players or playing teams compete with each other are based on occupations, real estate and finance, and are well known in the art and need not be listed. One example of a game in real estate and finance is the well known game of "Monopoly".

Other games are known that can be played by a number of players and which have the capability of enabling a player or a team of players to make changes in position during the game. Typical of such games are those relating to election games or games simulating politics, such as for example games covered by U.S. Pat. No. 4,299,390 (Election Board Game with Campaign Promise Markers) and U.S. Pat. Nos. 3,368,816 (Political Game) and 3,318,601 (Apparatus for Playing Election Game).

Educational games are known in the art which utilize a playing board, game pieces, markers and score sheets and which have as their object the educating of the players in a certain field of knowledge. Typical of such educational games are those disclosed in U.S. Pat. Nos. 3,711,966 (Geographical Game) and 2,177,790 (Educational Game). Games involving game boards and playing pieces for war games are known, U.S. Pat. No. 1,713,455, a military game, being exemplary.

Another known educational game used for the training and/or education of an acting artist is a game known as PERSUADE. The PERSUADE game comprises three boxes of situation cards identified as "character," "role," and "location." The acting student, or player, as the case may be, who is to perform draws one each of the "character," "role," and "location" cards. The student, or player, then improvises a scene depicting the text contained on the various cards. The improvisational performance of the student, based on the text of the drawn cards, is critiqued for the purpose of providing a student with "feedback" on the acting performance.

Each of the known prior art games provides amusement to the players, participants and spectators. Certain of the known games are intended to appeal to specific age groups and are based on the ability of players to follow directions and to communicate to other participants during game play.

SUMMARY OF THE PRESENT INVENTION

The present invention relates to a performing artist game which has, as its primary form of play, the requirement that a performing player of a playing team perform an audition that is typical of an audition required for a performing artist in a number of known performing art fields. The audition requirement is combined with the concept of playing team members observing an impromptu audition performance for the purpose of determining specific information from that performance in order to develop multipart answers to a specific team question.

The performing artist game of the present invention comprises a game board having a plurality of sides one of which has a playing surface defined thereon. The playing surface includes indicia thereon which define a first space central of the playing surface having a predetermined pattern, which, in the preferred embodiment, is a five pointed star. The first space includes means defining a transistion place from which play is commenced and terminated. The playing surface indicia also defines a group of second spaces which extend in a playing path on the playing surface in a predetermined pattern, which, in the preferred embodiment, is also a five pointed star. The group of second spaces encloses the first space and one of the second spaces of the group of second spaces is contiguous with the transistion space to define a transistion playing path between the first space and the group of second spaces. The group of second spaces contains indicia indicative of a predetermined number of performing art fields, which indicia are preferably in the form of graphical representations of the performing art fields of commerical, television, theater, music and movies. The game includes a plurality of distinct play pieces which are adapted to be advanced along the playing path defined by the group of second spaces and the transistion playing path. A chance means is used for randomly determining the number of spaces a play piece is to be advanced along the playing paths during a turn. A plurality of audition cards are used in the playing of the game and each audition card includes a situation side and a question side. The situation side includes means defining a plurality of performing artist roles, such as, for example, a role played or a statement made by a famous actor in a well known situation such as a movie, stage play or the like. The indicia is in the form of graphical representations which correspond with the indicia indicative of the predetermined number of performing art fields on the group of second spaces on the playing surface. The question side includes means defining a question having multipart answers thereto associated with a performing artist role corresponding to one of the indicia of the predetermined number of performing art fields on the group of second spaces and on the indicia on the situation side of the audition card.

The playing surface of the performing artist game, in the preferred embodiment, further includes opportunity/calamity spaces and a plurality of opportunity/-calamity cards which correspond to and are used to provide randomly dispursed variances of normal play by adding opportunities or calamities into the playing of the game. The group of second spaces, in the preferred embodiment, further includes indicia representing audition studios and places of performance which likewise are intended to provide variances to the playing of the game.

The performing artist game of the present invention simultaneously (a) provides a game that can be played by a small number of players forming two playing teams or a maximum of five playing teams having a large number of members, and (b) enables each member of a playing team to participate in the game itself as a performing player by performing an audition randomly assigned to that performing player from one of the performing art fields, which performance directly affects that performing player's team and contributes to that team's ultimate win or loss of the game.

None of the known prior art games have the intrinsic ability to accommodate a wide variation in the number of playing teams and number of performing players within the structure of each playing team wherein each member of a playing team can directly participate in the game by performing an impromptu audition of a performing artist role and wherein the effect of that performance directly affects that player's team performance.

In the known prior art games, the concept of one or more playing teams competing with each other is known, but none of the prior art games rely on the ability of the performing player in performing an audition using all communication skills.

Certain of the known prior art games, which include fixed playing paths and fixed playing rules, are intended to rely primarily on the use of dice and moving pieces for playing of the game and are not structured to utilize a player's performing skills and personal experience. Other of the known prior art games using a set of rules to guide the game are directed primarily toward using technical knowledge or skill of a player and that player's personal intelligence for playing games of politics, war or educational fields. Other of the known prior art games rely on a player's creative ability to overcome artificially imposed limitations, such as limiting the use of speech as a means of communication during actual game performance. The use of pantomime or body movement is relied on as a substitute for or used in lieu of speech or audible sounds for communication between the playing member and the remaining members of the playing team.

The present invention is based upon a performing player using verbal and acting skills and personal experience and knowledge to perform an impromptu audition. Both the skill of the performing player in giving the audition and the playing team's general and specific knowledge of the performing art fields, as well as the playing team member's capability of interpreting the performing player's audition performance, extract therefrom specific information to provide multipart answers to a team question concerning the audition performance. Such a concept is not taught, suggested, or disclosed by the prior art.

One advantage of the present invention is that the performing artist game utilizes a game board together with chance means, for example a spinner or die, together with audition cards to randomly assign a performing artist role to a performing player. The primary game action occurs away from the gaming board in that winning of the game is based upon the impromptu audition performance of the performing player assigned a performing artist role and on the interaction which occurs between the performing player and the other members of the playing team.

Another advantage of the present invention is that the game board can include in the playing path, defined by the group of second spaces, spaces containing indicia wherein the performing artist role requires the playing team to answer a greater number of parts of a question compared to other spaces in the playing path. Thus, the levels of required performance are increased from time-to-time to increase the difficulty of a playing team's performance thereby giving other teams an opportunity to close the scoring gap and perhaps overtake a poorer performing playing team.

Yet another advantage of the present performing artists game is that the group of second spaces may include indicia representative of an opportunity/-calamity which randomly can affect a players team ability to proceed with a performing players audition performance. The variance in performance can affect the game in either a positive or negative manner, providing a playing team with an unexpected opportunity to improve its scoring position or, alternatively, with an unexpected calamity which may adversely affect that team's opportunity to win the game.

Yet another advantage of the present invention is that the interaction between each member of a playing team is progressively increased during the off board game action due to the requirement that an increasing number of sections of a multipart answer to a team question must be answered correctly in order to enable a playing team to advance around the board to the central casting area. In the central casting area a final star performance is required of the performing player in response to the playing teams play piece advancing along the entire playing path into the first space central of the game board. A star performance requires that the members of the playing team successfully answer, in a predetermined time period, at least two parts of multipart answers to the team question as set forth on the question side of an audition card. An opposing team selects an audition card from the audition card stack and selects which performing artist role from that audition card is to be performed. The playing team then selects which of its members is to be the performing player. This final performance, to have that specific playing team declared the "Winner", requires that the playing team interpret the audition performance to answer correctly at least two parts of the multipart answer to the team question during the allotted time. If the playing team misses the question, it continues to try on successive turns in other selected audition categories. If the playing team misses in 5 audition categories, it loses the game.

Another advantage of the present invention is that members assigned to each team can be selected on the basis of artistic knowledge, artistic ability, and knowledge of the entertainment and performing arts fields to provide evenly balanced competing playing teams.

Yet another advantage of the present invention is that a member of a playing team can gain both in knowledge of the various performing art fields, such as commerical, television, music, theater and movies, and in personal experience of what is required in performing before an audience.

Another advantage of the present invention is that the predetermined pattern of the first space central of the playing board and/or the predetermined pattern of the playing path defined by the group of second spaces can be in the form of a five pointed star commonly associated with a star performance of an actor.

Another advantage of the present invention is that a common indicia for each performing art field can be used for the indicia on the group of second spaces and indicia on both the situation side and team question side of the audition card. For example, (1) the commercial performing art field can be represented by the graphical representation of a clackerboard used in film-making; (2) the television performing art field can be represented by the graphical representation of a television set; (3) the music performing art field can be represented by the graphical representation of a music staff and notes; (4) the theater performing art field can be represented by the graphical representation of masks of comedy and tragedy; and (5) the movie performing art field can be represented by the graphical representation of a movie reel and film.

Yet a further advantage of the present invention is that the play pieces can be formed into a five pointed star and be of different colors such that each playing team can be assigned a color and the five pointed star theme can be carried out to include the playing pieces.

BRIEF DESCRIPTION OF THE DRAWING

These and other advantages of the present invention will become apparent from the foregoing description of the preferred embodiment when considered together with the illustrations in the accompanying drawing which includes the following figures.

DESCRIPTION OF THE PREFERRED EMBODIMENT

Figure 1:
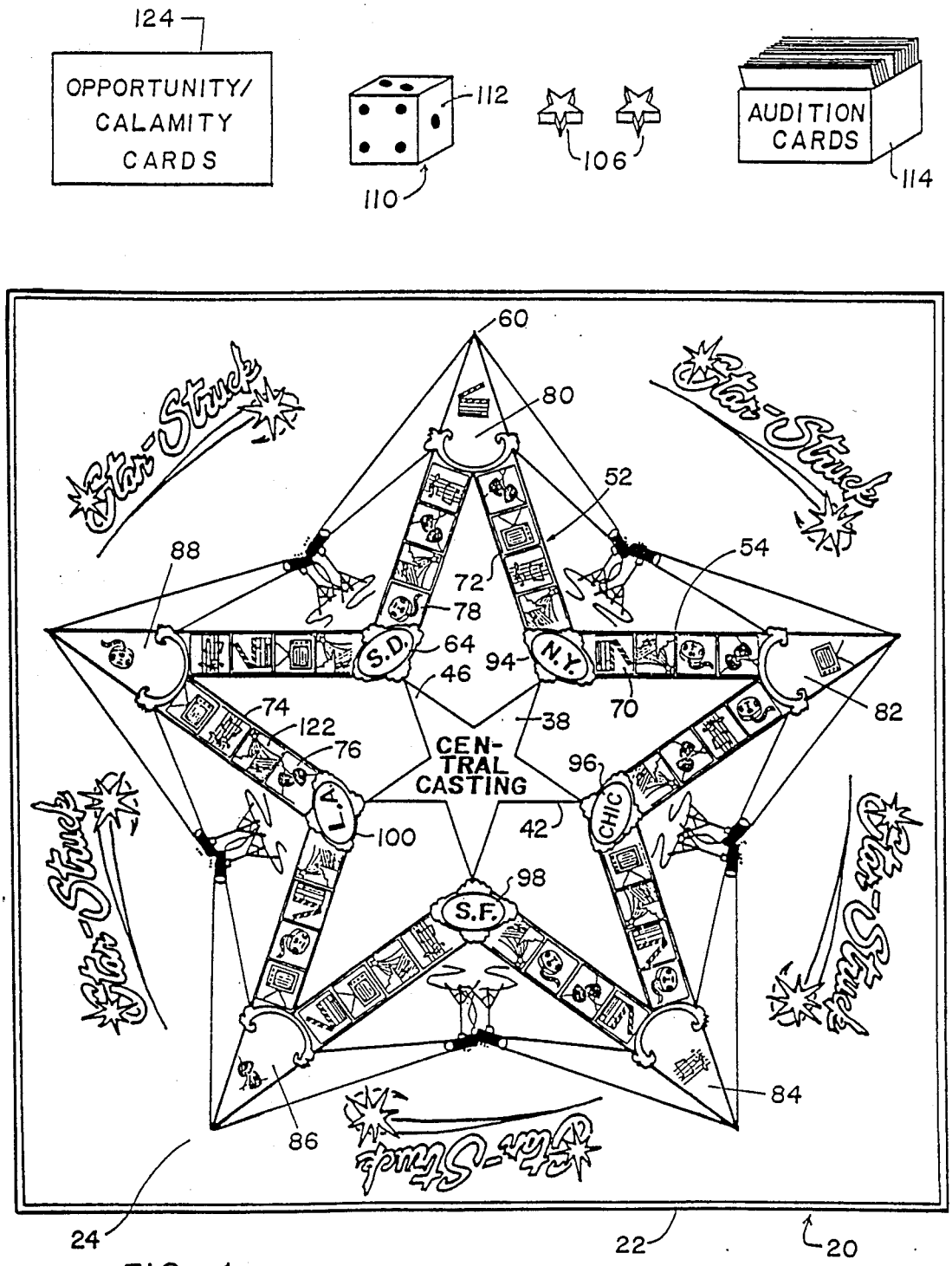
FIG. 1 is a top plan view of a game playing board, audition cards in a storage box, opportunity/calamity cards, play pieces, and die; the details of the game board playing surface having the first central space enclosed by the group of second spaces defining the playing path.

Refering to FIG. 1, the game indicated by arrow 20 includes a foldable game board 22 having a plurality of sides and edges, with one of the sides defining a playing surface 24. The playing surface 24 includes indicia thereon defining a first space 38 central of the playing surface having a predetermined pattern. In the embodiment of FIG. 1, the predetermined pattern is in the form of a five pointed star illustrated as 42. The first space 38 has one of its points of star 42 defining a transistion place illustrated as point 46, from which play is commenced and terminated. In the embodiment of FIG. 1, the star 42 is labeled "CENTRAL CASTING" to designate that area as the area on the playing surface 24 where play is to commence and terminate.

Figure 5:
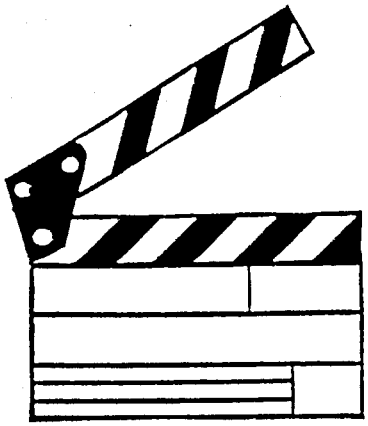
FIG. 5 is a graphical representation of a sign-board used in film-making to represent the commerical performing art field and is one of the common indicia used in the group of second spaces and on the situation and team question sides of the audition cards.
Figure 6:
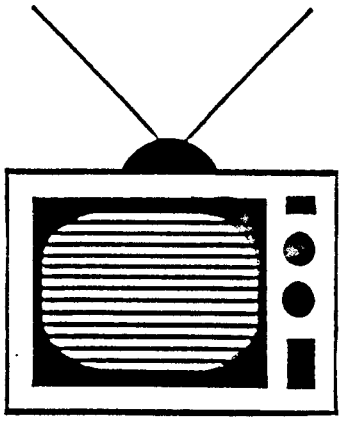
FIG. 6 is a graphical representation of a television set to represent the television performing art field and is one of the common indicia used in the group of second spaces and on the situation and team question sides of the audition cards.
Figure 7:
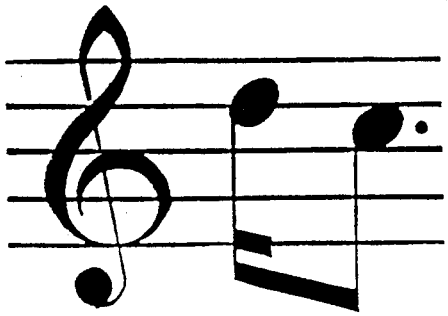
FIG. 7 is a graphical representation of a music staff and notes to represent the music performing art field and is one of the common indicia used in the group of second spaces and on the situation and team question sides of the audition cards.
Figure 8:
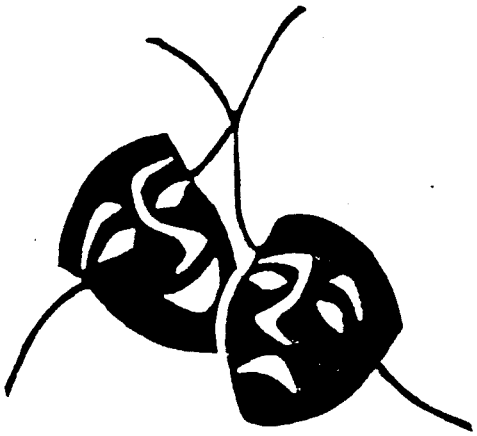
FIG. 8 is a graphical representation of the masks of comedy and tragedy to represent the theater performing art field and is one of the common indicia used in the group of second spaces and on the situation and team question sides of the audition cards.
Figure 9:
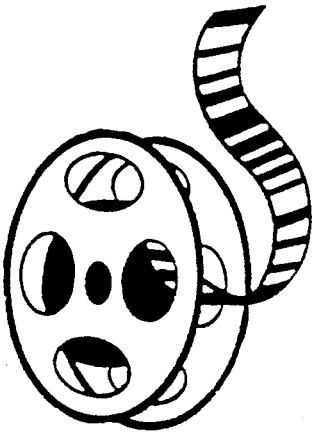
FIG. 9 is a graphical representation of a movie reel and film to represent the movie performing art field and is one of the common indicia used in the group of second spaces and on the situation and team question sides of the audition cards.

The playing surface 24 of the game board 22 includes indicia thereon defining a group of second spaces, shown generally as 52, extending in a playing path 54 on the playing surface 24 and enclosing the first space 38 which is in the form of a five pointed star 60. The group of second spaces 52 have one of the second spaces, which in the embodiment of FIG. 1 is an intersection of legs of two points defining the star and which is referred to herein as a valley 64 marked S.D., which stands for STAGE DOOR, contiguous with said transistion space 46 of the first space 38 and specifically pointed end 46 of the five pointed star 42, to define a transistion playing path between the first space 38 and the group of second spaces 52. The group of second spaces 52 contains indicia indicative of a predetermined number of performing art fields. In the embodiment of FIG. 1., the following indicia are represented:

The indicia for the commerical performing art field is shown as 70 and has the graphical representation illustrated in FIG. 5 hereof;

The indicia for the television performing art field is shown as 72 and has the graphical representation illustrated in FIG. 6 hereof;

The indicia for the music performing art field is shown as 74 and has the graphical representation illustrated in FIG. 7 hereof;

The indicia for the theater performing art field is shown as 76 and has the representation illustrated in FIG. 8 hereof; and The indicia for the movie performing art field is shown as 78 and has the representation illustrated in FIG. 9 hereof.

In the embodiment of FIG. 1, each point of the five pointed star 60 defines a casting studio which represents the casting audition for the specific performing art field represented by the indicia, such as point 80 for the commercial casting studio, point 82 for the television casting studio, point 84 for the music casting studio, point 86 for the theater casting studio and point 88 for the movie casting studio. In addition, the playing surface 24 defines in the remaining intersection of legs of the other star points four valleys, 94, 96, 98, and 100 of the five pointed star 60 indicia in the form of text to represent geographical places for performance. In the embodiment of FIG. 1, the places of performances represented by the valleys are the New York Union Hall in the valley numbered 94 with the letters "N.Y."; Chicago Union Hall, in the valley numbered 96 with the letters "Chic"; San Francisco Union Hall, in the valley numbered 98 with the letters "S.F."; and Los Angeles Union Hall, in the valley numbered 100 with the letters "L.A.".

The performing artists game illustrated in FIG. 1 further includes a plurality of distinct play pieces, labeled 106, to be used by a playing team and which are adapted to be moved along the second spaces 52 in said playing path 54 and the transistion playing path between valley 64 and point 46 of the five pointed star 42.

The performing artists game illustrated in FIG. 1 further includes a chance means 110, which in the preferred embodiment is a single die 112, for randomly determining the number of spaces a play piece may be moved along the playing paths 54 and transition paths 46 and 64 during a playing team's turn.

A plurality of audition cards including a situation side and a question side, shown generally as 114, are used to assign the performing artist role and team questions which are described in greater detail in FIGS. 11 and 12 hereinbelow.

The game board playing surface includes another indicia in the preferred embodiment which is used to vary the play routine. In FIG. 1, the group of second spaces 52 includes an opportunity/calamity graphical representation 122, the graphical representation of which is shown in greater detail in FIG. 10 hereof. The graphical representation in FIG. 1. is used in conjunction with Opportunity/Calamity cards, shown generally as 124, to vary the game routine during play. The details of the Opportunity/Calamity cards are discussed in greater detail in connection with FIGS. 13, 14 and 15 hereof.

Figure 2:
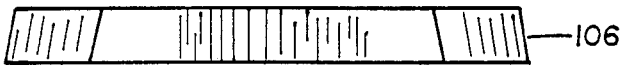
FIG. 2 is a front elevation view of a play piece in the form of a five pointed star.
Figure 3:
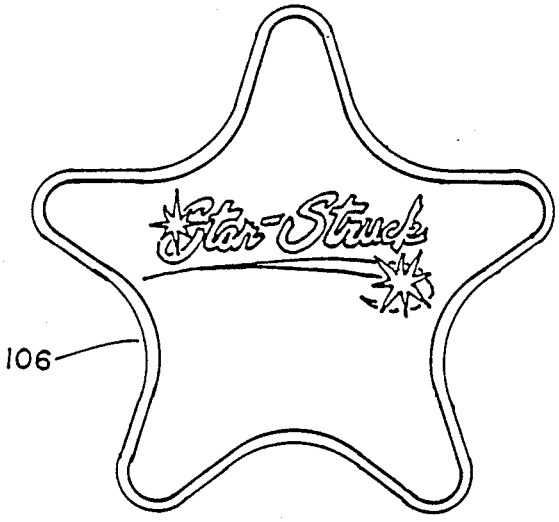
FIG. 3 is a top plan view of the star shaped play piece of FIG. 2.
Figure 4:
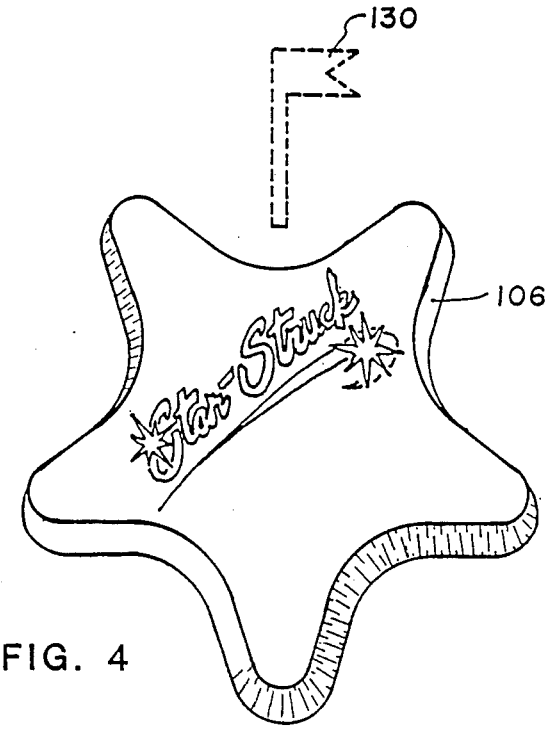
FIG. 4 is a perspective view of the star shaped play piece of FIGS. 2 and 3.

FIGS. 2, 3 and 4 illustrate the play pieces 106, in the preferred embodiment, that are formed into a five pointed shape to correspond with the five pointed star theme used on the playing board. In FIG. 4, alternatively, the star shaped playing piece may include an aperture to receive and support a game marker illustrated by the dashed line banner 130. The five point star scheme coordinates the concept with the object of the performing artist game, which is to win the game by one of the playing teams advancing its play piece through the entire playing path including performing artist roles, studio casting roles, union hall performance roles, and the final center stage role where at least two of the multipart answers to the team question must be correctly answered within the allotted time period.

FIG. 5 is the graphical representation of a clackerboard used in film-making and which, in this embodiment, is used for the commerical performing artist role. The common graphical indicia is used in FIG. 1 as one of the group of second spaces illustrated as 70 in FIG. 1., for indicating the same performing artist role on the situation side of the audition card as shown by indicia 142 in FIG. 11 and for indicating the appropriate team question for the associated performing artist role as indicated by indicia 156 in FIG. 12.

FIG. 6 is the graphical representation of a television set which, in this embodiment, is used for the television performing artist role. The common graphical indicia is used in FIG. 1 as one of the group of second spaces illustrated as 72 in FIG. 1., for indicating the same performing artist role on the situation side of the audition card as shown by indicia 144 in FIG. 11 and for indicating the appropriate team question for the associated performing artist role as indicated by indicia 158 in FIG. 12.

FIG. 7 is the graphical representation of a music staff and notes which, in this embodiment, is used for the music performing artist role. The common graphical indicia is used in FIG. 1 as one of the group of second spaces illustrated as 74 in FIG. 1, for indicating the same performing artist role on the situation side of the audition card as shown by indicia 146 in FIG. 11 and for indicating the appropriate team question for the associated performing artist role as indicated by indicia 160 in FIG. 12.

FIG. 8 is the graphical representation of the masks of comedy and tragedy which, in this embodiment, is used for the theater performing artist role. The common graphical indicia is used in FIG. 1 as one of the group of second spaces illustrated as 76 in FIG. 1, for indicating the same performing artist role on the situation side of the audition card as shown by indicia 148 in FIG. 11 and for indicating the appropriate team question for the associated performing artist role as indicated by indicia 162 in FIG. 12.

FIG. 9 is the graphical representation of a movie reel and film which, in this embodiment, is used for the movie performing artist role. The common graphical indicia is used in FIG. 1 as one of the group of second spaces illustrated as 78 in FIG. 1, for indicating the same performing artist role on the situation side of the audition card as shown by indicia 150 in FIG. 11 and for indicating the appropriate team question for the associated performing artist role as indicated by indicia 164 in FIG. 12.

Figure 10:
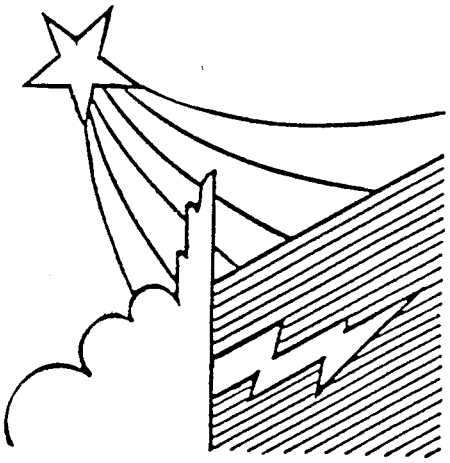
FIG. 10 is a graphical representation, including a star representing opportunity, and a cloud, rain and thunder bolt representing calamity, which is used as the indicia on the playing surface in the group of second spaces and one side of the opportunity/calamity cards.
Figure 13:
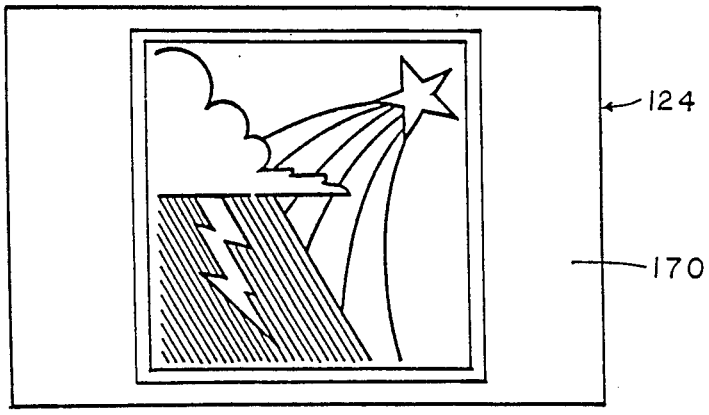
FIG. 13 is the disclosed side of the opportunity/-calamity side of a typical opportunity/calamity card using the graphical representations of FIG. 10 which correspond to the indicia on the playing surface in the group of second spaces.
Figure 14:
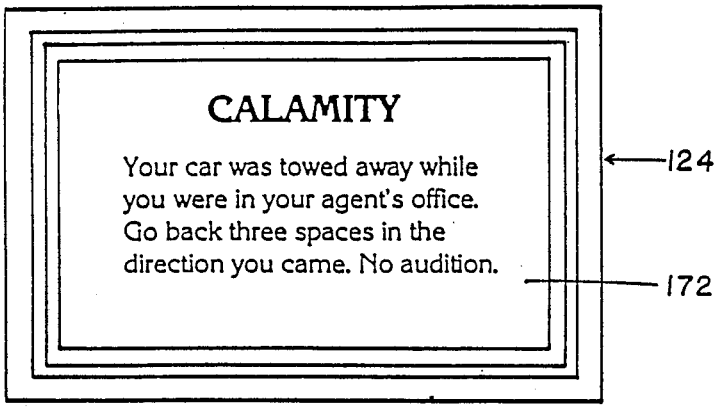
FIG. 14 is an example of one of the texts of a calamity which is located on the opposite side of an opportunity/calamity card and which is an undisclosed surface during play.
Figure 15:
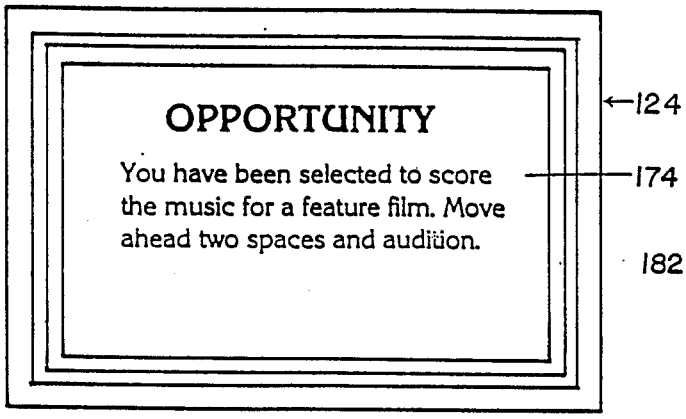
FIG. 15 is an example of one of the texts of an opportunity which is located on the opposite side of an opportunity/calamity card and which is an undisclosed surface during play.

FIG. 10 is the graphical representation of an opportunity/calamity which, in this embodiment, is used for randomly varying the playing teams move by introducing an unexpected opportunity or loss into the game. As noted below, the details of the opportunity/calamity cards are illustrated in FIG. 13, 14 and 15. The common graphical indicia is used in FIG. 1 as one of the group of second spaces illustrated as 122 in FIG. 1.

Figure 11:
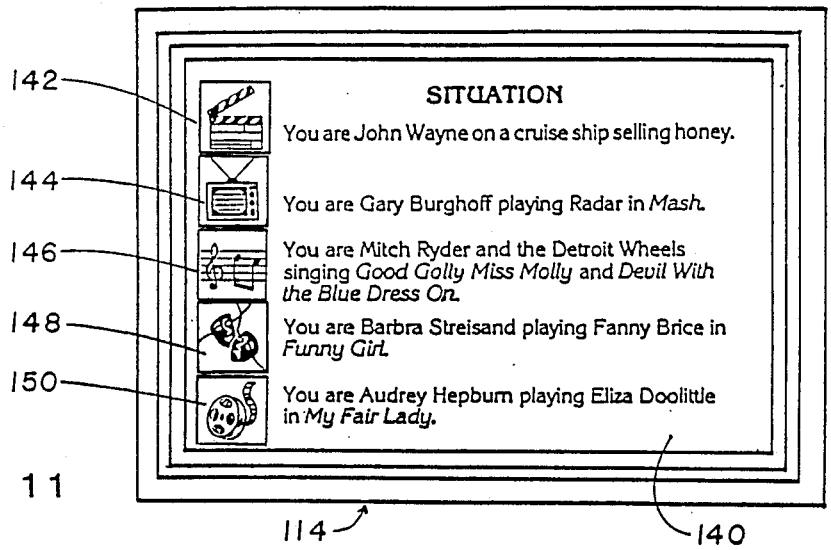
FIG. 11 is the situation side of the audition card using the graphical representations of FIGS. 5 through 9 as the indicia thereon for the performing artist role and illustrates one example of the various situations for each of the five performing art fields for which an audition is to be performed.
Figure 12:
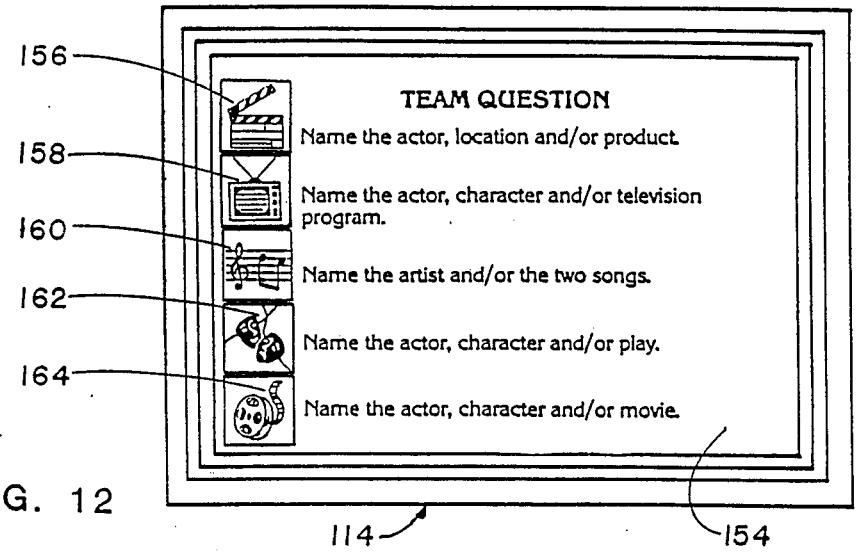
FIG. 12 is the team question side of the audition card using the graphical representations of FIGS. 5 through 9 as the indicia thereon for the team question corresponding to the performing artist roles on the situation side illustrated in FIG. 11 and illustrates one example of the various multipart answers to team questions for each of the five performing art fields for which an audition is to be performed.

FIG. 11 and 12 illustrate the opposite sides of an audition card and illustrate the situation side 140 and the opposite team question side 154. The situation side 140 includes means defining a plurality of performing artist roles which correspond with the indicia indicative of the predetermined number of performing art fields on the group of second spaces on the playing surface. In the embodiment of FIG. 11, there are five performing artist roles illustrated, which are: (a) commercial represented by indicia 142; (b) television represented by indicia 144; (c) music represented by indicia 146; (d) theater represented by indicia 148; and (e) movie represented by indicia 150.

The team question side 150 includes means defining the multipart answer required to the team question associated with one of the plurality of performing artist roles which correspond with the indicia indicative of the predetermined number of performing art fields on the group of second spaces on the playing surface. In the embodiment of FIG. 12, there are five performing artist roles illustrated, which are: (a) commercial represented by indicia 156; (b) television represented by indicia 158; (c) music represented by indicia 160; (d) theater represented by indicia 162; and (e) movie represented by indicia 164.

During play, the following interrelationships exist in the role of the indicia discussed above. For example, assume that a play piece for playing team number I is advanced to space 70 in FIG. 1. The performing player of playing team number I then draws an audition card from the box 114 illustrated in FIG. 1. Assume further, that the drawn audition card is illustrated by FIGS. 11 and 12. The performing player of playing team number I, would then silently read the situation corresponding to the indicia 142, which in turn, corresponds to the indicia 70 in FIG. 1. That situation or performing artist role is read to be:

"You are John Wayne on a cruise ship selling honey."

Thus, the performing player must audition using the directions stated above.

Then the performing player reads aloud, for all to hear, the team question appearing on side 154 of FIG. 12 which corresponds to the indicia 156 in that the same indicia corresponds to the indicia 70 in FIG. 1 and to the indicia 142 in FIG. 11. In FIG. 12, the information to be read aloud is as follows:

"Name the actor, location and/or product."

Thereupon the performing player commences the audition in order for the other team members of playing team number I to determine the answers to each part of the multipart answer required by the team question. The performing player cannot merely give the answer, but must act out the role in an acting manner, and include sufficient information in the impromptu audition to convey to the other members the necessary information required to answer all parts of the mulitpart answer to the team question.

A time period of three (3) minutes is given for the other members of the playing team number I to provide at least one or all answers to the multipart answer required for the above performing artist role for a space located in the playing path 52 which does not include other indicia.

FIGS. 13, and 14 illustrate one example of an opportunity/calamity card 124 wherein the card contains text relating to a calamity on a covered side 172. The graphical representation of FIG. 13 is the front or published side 170 of the card, and is the side which is readable to all players. In the example of the opportunity/calamity card of FIG. 14, the text appearing on side 172 describing the calamity must be followed by the playing team. In the example of FIG. 14, the calamity is stated as follows:

Your car was towed away while you were in your agent's office. Go back three spaces in the direction you came. No audition.

The above calamity text requires that the playing team move its play piece back three spaces on the playing path. The playing team experiences a loss of three spaces in its advance toward the STAGE DOOR and CENTRAL CASTING and is deprived of the opportunity of having a performing player perform an audition. The calamity is intended to be a random unexpected variance of game play and affords other teams the opportunity to improve their game posture over the playing team experiencing the calamity.

FIGS. 13, and 15 illustrate one example of an opportunity/calamity card 124 wherein the card contains text relating to an opportunity on a covered side 174. The graphical representation of FIG. 13 is the front or published side 170 of the card, and is the side which is readable to all players. In the example of the opportunity/calamity card of FIG. 15, the text appearing on side 174 describing the opportunity must be followed by the playing team. In the example of FIG. 15, the opportunity is stated as follows:

You have been selected to score the music for a feature film. Move ahead two spaces and audition.

The above opportunity text requires that the playing team move its play piece forward two spaces on the playing path. The playing team experiences a gain of two spaces in its advance toward the STAGE DOOR and CENTRAL CASTING. In addition, the playing team is provided the opportunity of having a performing player perform an audition determined by the indicia shown in that space. It is possible for the performing team to gain up to three additional spaces if it answers all three parts of the multipart answer to the team question As a result, the playing team is given the opportunity to advance its playing piece which is an object of the game. The opportunity is intended to be a random unexpected variance of game play and affords the playing team the opportunity to improve its game posture over the other playing teams.

Figure 16:
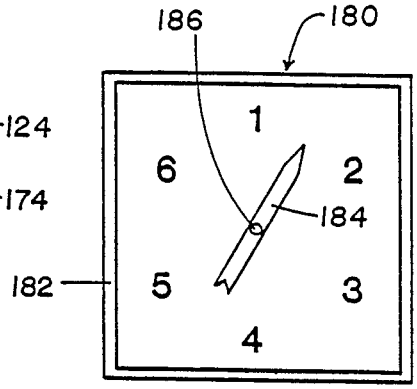
FIG. 16 illustrates a chance means in the form of a spinner shown in a top plan view and having the numerals 1 through 6 thereon.
Figure 17:
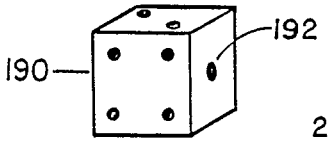
FIG. 17 illustrates a chance means in the form of a single die shown in a perspective view and having dots thereon representing the numerals 1 through 6.

FIGS. 16 and 17 illustrate two examples of a chance means which can be used to randomly direct the number of spaces to be advanced by a playing team during its turn to play. FIG. 16 comprises a spinner 180 having a base 182 which has the numerals 1 through 6 placed in a preselected pattern thereon. A rotatable pointer 184 is pivotly mounted by a fastening means 186 on the base 182 and is positioned such that when the pointer is spun by a playing team, the arrow end thereof will be close or directly pointing at a number. This number is the number of spaces that a playing team must advance on the playing path illustrated in FIG. 1.

FIG. 17 illustrates a typical six-sided die 190 having dots, of which dot 192 is typical, representing the numerals 1 through six. The die is rolled in a typical manner, and the number appearing on top is the number of spaces that a playing team must advance on the playing path illustrated in FIG. 1.

In the preferred embodiment, the maximum number of moves that is provided by the chance means is selected to be six spaces. It is envisioned that the maximum number of moves can be greater or lesser than six spaces, depending on the period of time over which the game is to be played.

Figure 18:
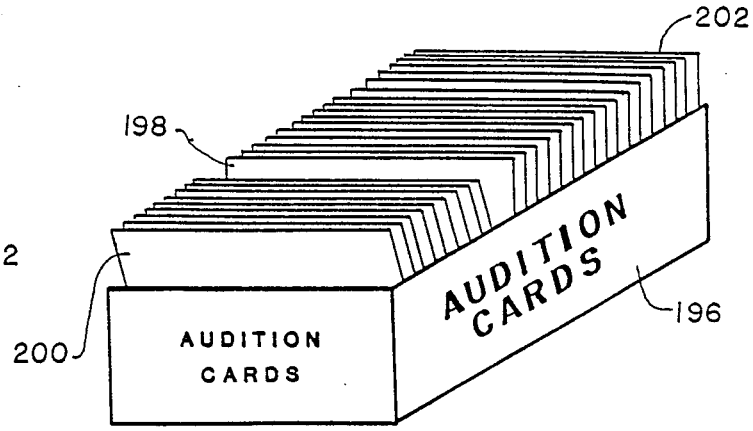
FIG. 18 illustrates a plurality of audition cards stored in a storage box, shown in a perspective view, for easy removal from the front thereof during play and reinsertion into the storage box at the rear thereof after play.

FIG. 18 is an illustration of how a plurality of audition cards are stored and used during a game. An elongated storage box 196 holds a plurality of audition cards 198. When a playing team is required to draw an audition card, the card is drawn from the front 200 of the box 196. When the card has been used and must be discarded, that audition card is placed at the rear 202 of the box 196.

CONCEPT OF PLAY

The above description of the performing artist game describes the equipment required for playing the game. The following description covers the various levels of play and the rules of play.

In use, the performing artist game can be played with a minimum of two teams each having a minimum of two players. However, it is possible to have up to five playing teams, and there is no maximum to the number of players on each team. For purposes of definition, a "playing team" has playing team members. During a playing team's turn, one of the playing team members must perform the auditions. Each member of a playing team, in sequence, must perform, as each team is required to have an audition as the game progresses. When that team member is the performing member, that person is referred to as the "performing player".

In the performing artist game, there are three levels of auditions. These are:

(A) Level One-Indicia (THE PLAYING PATH) between points of the five pointed star of the playing path defined by the group of second spaces; Minimum requirement is for playing team to answer one of the three parts of the multipart answer to the team question in order to advance one space;

(1) Audition spaces, having graphical representations corresponding to FIGS. 5 through 9. These spaces require the use of the audition card which has the situation side and the team question side as described above. When the performing player performs the audition, the other members of the performing team must answer at least one part of the multipart answer in order to advance. Since each team question has three parts to the answer, the performing team is required to answer at least one part correctly to advance. Thus the playing team play piece can be advanced from one to three spaces at this audition level.

(2) Opportunity/Calamity spaces having graphical representations corresponding to FIG. 10. These spaces require the use of an opportunity/calamity card which has a calamity text or an opportunity text on the covered side of the card as described above. When the performing player lands on an opportunity/calamity space, the playing team performing player draws an opportunity/calamity card from the stack and reads it aloud. Thereupon, the playing team must perform the instruction set forth on the text of the drawn opportunity/calamity card including moving of the play piece the number of spaces directed by the card.

(3) UNION HALL and STAGE DOOR - There are no corresponding cards to these indicia. If the playing team play piece lands on any one of the UNION HALL/STAGE DOOR spaces, the following occurs. The performing player draws an audition card from the box and then chooses any one of the five performing artist roles, and reads the associated team question to the other members of the playing team. Thereupon, the performing player performs the selected audition using the instructions of the selected performing artist role from the situation side of the audition card. The playing team then answers as many parts of the multipart answer to the team question as is possible during the allotted playing time. Thus, the playing team can advance a minimum of one space and up to a maximum of three spaces during a UNION HALL/STAGE DOOR performance.

(B) Level Two-Indicia (CASTING STUDIOS) located at the points of the five pointed star of the playing path defined by the group of second spaces; Minimum requirement is for playing team to answer two of the three parts of the multipart answer to the team question in order to advance two spaces;

There are no corresponding cards to these indicia. The text on the game board playing surface identifies these points as "CASTING STUDIOS". There are five casting studios corresponding to the five performing artist roles, those being commercial, television, music, theater and movie. If the playing team play piece is located on a space which is six or less spaces from a CASTING STUDIO, the playing team needs to stop when it reaches the CASTING STUDIO. For example, assume the play piece is five spaces away from the CASTING STUDIO. The playing team's chance means shows a four, advancing the play piece to within one space from the CASTING STUDIO. An audition is then performed as described above. The playing team need answer only one part to the multipart answer required to the team question to advance the one space required to reach the CASTING STUDIO space.

When the playing team play piece lands on the CASTING STUDIO space, the following occurs. The performing player draws an audition card from the box and silently reads the performing artist role that matches the casting studio space where the playing piece landed and then reads aloud the associated team question to the other members of the playing team. The playing team must answer two of the three parts of the multipart answer to the team question in order to advance. If, after three turns, the playing team has not successfully answered at least two parts of a multipart answer to a team question, on the fourth turn, the playing team proceeds with normal play.

(C) Level Three-Indicia located at the first space central of the five pointed star labeled "CENTRAL CASTING"; Minimum requirement to win game is for playing team to answer two of the three parts of the multipart answer to the team question;

There are no corresponding cards to these indicia. The text on the game board playing surface identifies this space as "CENTRAL CASTING." The CENTRAL CASTING space is used in conjunction with the STAGE DOOR space. The playing team must advance around the playing path to the space marked STAGE DOOR which is the entrance to CENTRAL CASTING. As with CASTING STUDIOS, if the playing team rolls a number greater than the number of spaces to CENTRAL CASTING, the team's play piece stops at the CENTRAL CASTING space. For example, assume that the play piece is five spaces away from the CENTRAL CASTING space. The playing team's chance means shows the number three, advancing the play piece to two spaces from the CENTRAL CASTING space. An audition is then performed as described above. The playing team need answer two parts to the multipart answer required to the team question to advance the two spaces required to land on the CENTRAL CASTING space. If the playing team had received a number 6 from the chance means, then the number of moves would have been sufficient to carry the team play piece into the CENTRAL CASTING space with the STAGE DOOR counting as a separate space. If a play piece has landed on the STAGE DOOR space, and an audition is performed by the performing player, the playing team needs only have one correct answer of the multipart answer to the team question in order to land on the CENTRAL CASTING space.

When the playing team play piece lands on the CENTRAL CASTING space, the following occurs. The opposing team, or one of the opposing teams if more than two playing teams, draws an audition card and selects one of the five performing artist roles from the audition card. The playing team then selects which of its members is to be the performing player, without regard to sequence The performing player reads the associated team question to the other members of the performing team. The playing team must answer two of the three parts of the multipart answer to the team question to win the game. This process is repeated on each turn of the playing team and continues until the playing team has successfully answered at least two parts of a multipart answer to a team question, except, however, if the performing team fails to answer at least two parts of a multipart answer to a team question for all five of the performing artist roles, that playing team automatically loses the game.

The following are the Formal Rules of Play.

HOW TO PLAY STAR-STRUCK

STAR-STRUCK is a performing arts game using skills, knowledge, and nerve of four or more players divided into teams for unlimited entertainment and fun. The following are the Formal Rules of Play.

CONTENTS:

Each Star-Struck game includes: one game board, five star shaped playing pieces, two timers, one die, 200 Audition cards, and 100 Opportunity/Calamity cards.

OBJECT:

The object of Star-Struck is to be the first team to move around the board, clockwise from CENTRAL CASTING, by successfully auditioning in each casting studio and completing a final audition upon return to CENTRAL CASTING.

THE GAME:

First, divide players equally into 2 or more teams (a minimum of two teams with two players each to a maximum of five teams with any number of players per team). As a rule, fewer teams with more players per team make the best game. Each team selects a colored star for its team marker and places it in CENTRAL CASTING. The Opportunity/Calamity cards are shuffled and placed face down near the Audition Cards on the game board. One member of each team rolls the die. The player with the highest number rolls again and moves its team star marker from CENTRAL CASTING through the STAGE DOOR toward the COMMERCIAL CASTING STUDIO.

*Note: The STAGE DOOR counts as a space, as do UNION HALLS and CASTING STUDIOS.

The player then draws an Audition card or Opportunity/Calamity card matching the space where the marker landed and proceeds as described in "The Game Board" section. Play continues around the board clockwise with a different team rolling the die and auditioning on each turn until a team returns to CENTRAL CASTING through the STAGE DOOR for the "Final Audition".

TIMERS:

Two timers (three minute limit) are provided and may be shared when there are more than two teams playing. Auditions must be completed within the three minute limit.

THE GAME BOARD:

There are five kinds of spaces on the game board: (1) CENTRAL CASTING, (2) STAGE DOOR and UNION HALLS, (3) Audition Spaces, (4) Opportunity/Calamity Spaces, and (5) CASTING STUDIOS 1. CENTRAL CASTING—Play begins and ends here.

2. STAGE DOOR and UNION HALLS—These are free choice spaces. A player landing here may draw an Audition card and choose to perform one of the Situations. Or, the player may draw an Opportunity/-Calamity card and take a chance.

3. AUDITION SPACES—These are Situation spaces. There are five audition categories, each with a matching symbol, ie. COMMERCIALS, TELEVISION, MUSIC, THEATER, and MOVIES. When landing on an Audition space, the player draws an audition card and silently reads the Situation matching that space. The player then turns the card over to read the corresponding Team Question aloud. All parts of the Music, Television, Theater, and Movie Situations are factual. The Commercial Situations are make-believe. The player's objective is to act out the Situation as if performing for a real audition. The team objective is to identify the "who, what and/or where" of the player's performance within the three minute time limit.

There are three parts to every audition. A team does not need to answer all three parts of the question, however. The team moves ahead one space for each part answered correctly and this ends the turn. If a team misses all three parts, playing turn passes to the next team.

4. OPPORTUNITY/CALAMITY SPACES—These are the spaces with a rainbow star and storm cloud. When landing here, draw an Opportunity/-Calamity card and hope for sunny weather, for in acting, as in life, we all have our share of storm clouds and rainbows.

5. CASTING STUDIOS—There are five CASTING STUDIOS, one at each point of the star, representing the five AUDITION Situations GETTING IN—PLAYERS MUST stop and audition at EACH CASTING STUDIO. If the die roll is greater than the number of spaces between the star marker and the next CASTING STUDIO, stop at the CASTING STUDIO and audition on that turn. Players may also Audition their way into a CASTING STUDIO (if within one space of a CASTING STUDIO, a team needs only one correct part of the Audition Situation to move into the CASTING STUDIO). At this point the team's turn ends. On the next turn, instead of rolling the die, Draw an Audition card and proceed.

GETTING OUT—To get out of a CASTING STUDIO, the team must correctly answer at least two parts of the Team Question. If successful, move forward one space for each correct answer. This ends the turn. If unsuccessful in a CASTING STUDIO Audition, the team stays there to try again on successive turns. After three unsuccessful auditions in a CASTING STUDIO (or Audition space), roll the die and move forward on the next turn.

FINAL AUDITION:

When a team reaches CENTRAL CASTING for the FINAL AUDITION (see GETTING IN under CASTING STUDIOS), an opposing team draws an Audition card and selects a Situation for the FINAL AUDITION. The auditioning team then selects its performing player. If two out of three parts of the audition question are answered correctly, THE TEAM WINS THE GAME! If not, it must stay and try again with a new category and new performing team member selected for each additional audition. A team missing all five categories, LOSES!

NOTES TO PLAYERS:

This is an acting game. You can talk, sing, dance, use props, etc.. You can use an actor's accent, mannerisms, or facial expressions. You can even use an actor's famous lines; but remember to stay in character! Imagine your team to be a group of casting directors who have to believe that you are the actor/actress. BE the actor. If you know only one part of a Situation, work on that part. For example, if the actor is John Wayne and you have never heard of the role or the movie, then tell your team you are working on a part the actor played in another movie. If they can figure out that you are John Wayne, they may be able to guess the movie and character on your Situation card. No charades are permitted in the audition. Do not work on parts of a name i.e. "sounds like...", and don't describe or narrate "my character is ...tall, short, old, young." Also, do not give clues that are unrelated to the situation. The other team will be the judge as to whether or not you are staying in character or slipping into charades. If out of character, another team may call foul and cancel out that part of your Situation.

A COUPLE OF OTHER "DON'TS":

* Don't sing the title words to a song if they are on your Audition card. It is permissable to HUM the tune!
* Don't give up until the timer runs out.
* Don't take any of this too seriously and DO HAVE FUN!

WINNING THE GAME

The first playing team that enters the CENTRAL CASTING space and answers correctly two parts of the multipart answer to the team question is the winner. The remaining player teams can continue play to determine second, third place, etc..

METHOD OF PLAY

The basic method for playing the performing artist game with at least two playing teams comprises the following steps:

assigning an audition performance which includes a situation and a team question wherein the situation describes a performing artist role to be performed by a performing player of a playing team and wherein the team question requires a multipart answer corresponding to the performing artist role to be performed by a performing player of the playing team;

performing of the performing artist role by the performing player, which performance is observed by the other members of the playing team;

answering parts of the multipart answer to the team question by the other members of the playing team in response to information derived from observing the performing players performance;

the method of assigning the audition performance can be in a number of ways, such as by a chance means, die, wheel, spinner, or the like. It is envisioned that the basic method described hereinabove could be adapted to television in the form of a game show. The set for such a team show could include a large spinner, as a "wheel of fortune" or use a computer system to randomly asign the roles. The answers to the multipart questions could be shown to the audience. As the other members of the performing Team attempt to answer the questions, the audience would experience the entertainment and excitement as if participating in the performance.

What is claimed is:

1. A method for playing a performing artist game with at least two playing teams comprising the steps of:

providing a game board having a playing path divided into a plurality of spaces;

assigning each playing team a playing piece;

during a playing team's turn, advancing a playing piece along said playing path;

assigning an audition performance to a playing team, wherein the audition performance includes a situation describing a performing artist role and multipart question corresponding to the performing artist role;

selecting a performing player from said playing team;

performing of the performing artist role by the performing player, which performance is observed by the other members of the playing team;

answering parts of the multipart question by other members of the playing team in response to information derived from observance of the performing player's performance; and moving said playing team's playing piece if the playing team correctly answers said multipart question, wherein the number of proportional to numbers of spaces the playing piece can advance.

2. The method of claim 1 further comprising the step of:

initially advancing a playing team's playing piece using a random number generator, during the playing team's turn.

3. The method of claim 2 further comprising the step of:

providing indicia to a predetermined number of said spaces, said indicia representing different catagories of audition performances; and determining the audition performance to be assigned to a playing team upon said playing team's playing piece landing on a corresponding space.

4. The method of claim 3 further comprising the steps of:

providing a plurality of audition cards, each card including indicia representing the different catagories of audition performances and performing artist roles associated with each catagory on one side, and the multipart questions corresponding to each performing artist role on the opposite side; and determining the performing artist role to be performed by selecting an audition card and selecting the audition performance catagory on the card corresponding to the space landed on.

5. The method of claim 1 further comprising the step of:

providing opportunity or calamity situations by means of opportunity/calamity cards which correspond to opportunity/calamity indicia on the playing surface which require that when a playing team play piece lands on the opportunity/calamity indicia an opportunity/calamity card is drawn requiring that playing team to follow the instructions thereon resulting in an unexpected variance which affects the relationship between the playing teams.

6. A method for playing a performing artist game with at least two playing teams comprising the steps of:

providing a playing means having means defining a continuous series of spaces;

assigning each playing team a means for interacting with the playing means;

during a playing team's turn, moving said interacting means along said means defining a continuous series of spaces;

assigning an audition performance to a playing team, wherein the audition performance includes a situation describing a performing artist role and multipart question corresponding to the performing artist role;

selecting a performing player from said playing team;

performing of the performing artist role by the performing player, which performance is observed by the other members of the playing team;

answering parts of the multipart question by other members of the playing team in response to information derived from observance of the performing player's performance; and designating with said playing team's interacting means if the playing team correctly answers said multipart question, wherein the number of correctly answered parts to the multipart question is proportional to numbers of spaces the interacting means can advance.

7. The method of claim 6 further comprising the step of:

providing indicia to a predetermined number of said spaces, said indicia representing different catagories of audition performances; and determining the audition performance to be assigned to a playing team upon said playing team's interacting means landing on a corresponding space.

8. The method of claim 7 further comprising the steps of:

providing a plurality of audition cards, each card including indicia representing the different catagories of audition performances and performing artist roles associated with each catagory on one side, and the multipart questions corresponding to each performing artist role on the opposite side; and determining the performing artist role to be performed by selecting an audition card and selecting the audition performance catagory on the card corresponding to the space landed on.

9. The method of claim 6 further comprising the step of:

providing opportunity or calamity situations by means of opportunity/calamity cards which correspond to opportunity/calamity indicia on the playing means which require that when a playing team interacting means lands on the opportunity/calamity indicia an opportunity/calamity card is drawn requiring that playing team to follow the instructions thereon resulting in an unexpected variance which affects the relationship between the playing teams.

* * * * *